US011496846B2

(12) United States Patent
Hasani

(10) Patent No.: US 11,496,846 B2
(45) Date of Patent: Nov. 8, 2022

(54) HEARING AID

(71) Applicant: Sivantos Pte. Ltd., Singapore (SG)

(72) Inventor: Hamed Hasani, Erlangen (DE)

(73) Assignee: Sivantos Pte. Ltd., Singapore (SG)

( * ) Notice: Subject to any disclaimer, the term of this patent is extended or adjusted under 35 U.S.C. 154(b) by 0 days.

(21) Appl. No.: 17/169,743

(22) Filed: Feb. 8, 2021

(65) Prior Publication Data

US 2021/0250709 A1 Aug. 12, 2021

(30) Foreign Application Priority Data

Feb. 6, 2020 (DE) ..... 102020201480.9

(51) Int. Cl.
*H04R 25/00* (2006.01)
*H01Q 1/27* (2006.01)
*H04R 9/06* (2006.01)

(52) U.S. Cl.
CPC ..... *H04R 25/658* (2013.01); *H01Q 1/273* (2013.01); *H04R 9/06* (2013.01); *H04R 25/604* (2013.01); *H04R 2420/07* (2013.01)

(58) Field of Classification Search
CPC ..... H04R 2225/51; H04R 25/55; H04R 25/65
See application file for complete search history.

(56) References Cited

U.S. PATENT DOCUMENTS 9,521,494 B2 12/2016 Nikles
9,686,621 B2 * 6/2017 Akdeniz ..... H04R 25/554
10,477,329 B2 11/2019 Polinske et al.
10,777,892 B2 9/2020 Nikles et al.
2009/0231211 A1 * 9/2009 Zweers ..... H01Q 7/00 343/702
2010/0158295 A1 * 6/2010 Polinske ..... H01Q 1/243 343/866
2013/0171951 A1 7/2013 Li et al.
2013/0342407 A1 12/2013 Kvist et al.
2013/0343586 A1 * 12/2013 Kvist ..... H04R 25/554 381/315

(Continued)

FOREIGN PATENT DOCUMENTS

CN 104244156 A 12/2014
DE 102017012195 A1 12/2018

(Continued)

OTHER PUBLICATIONS

Fujimoto Kyohei: "sections 23.6.3.6 Small Chip Antenna to 23.6.4.2 Diversity Antenna", In: "Modern Antenna Handbook", Sep. 2, 2008 (Sep. 2, 2008), John Wiley & Sons, Incorporated, XP055813039, ISBN: 978-0-470-03634-1, pp. 1199-1217.

*Primary Examiner* — Ryan Robinson
(74) *Attorney, Agent, or Firm* — Laurence A. Greenberg; Werner H. Stemer; Ralph E. Locher

(57) ABSTRACT

A hearing aid contains a housing having a baseplate and a housing shell, a number of electrical units, and a transmitting and receiving unit for transmitting and receiving electromagnetic waves. The number of electrical units are fastened on the baseplate. The transmitting and receiving unit includes an electronic circuit for generating a transmission signal and an antenna unit coupled thereon, and the antenna unit includes a first antenna arm and a shielding element for shielding the first antenna arm against the number of electrical units.

19 Claims, 4 Drawing Sheets

(56) References Cited

U.S. PATENT DOCUMENTS

| | | | | |
|---|---|---|---|---|
| 2014/0010394 | A1* | 1/2014 | Kvist | H01Q 9/24 381/315 |
| 2015/0049891 | A1* | 2/2015 | Johnson | H04R 25/609 381/315 |
| 2016/0050501 | A1* | 2/2016 | Pinto | H04R 25/554 381/315 |
| 2016/0381471 | A1 | 12/2016 | Henriksen et al. | |
| 2017/0026762 | A1 | 1/2017 | Ruaro et al. | |
| 2017/0150278 | A1* | 5/2017 | Ruaro | H04R 25/60 |
| 2018/0124528 | A1* | 5/2018 | Polinske | H04R 25/602 |
| 2019/0069101 | A1* | 2/2019 | Kvist | H01Q 5/371 |
| 2019/0166437 | A1 | 5/2019 | Adel et al. | |
| 2019/0261100 | A1* | 8/2019 | Troelsen | H01Q 1/273 |
| 2020/0107141 | A1* | 4/2020 | Kvist | H04R 25/604 |
| 2020/0136241 | A1* | 4/2020 | Shriner | H01Q 9/0421 |
| 2020/0203812 | A1* | 6/2020 | Murray | H01Q 9/285 |
| 2020/0251811 | A1* | 8/2020 | Elghannai | H04R 25/554 |
| 2020/0275218 | A1* | 8/2020 | Xue | H01Q 1/362 |
| 2020/0314567 | A1* | 10/2020 | Shriner | H01Q 1/273 |
| 2020/0404434 | A1* | 12/2020 | Shriner | H04R 25/65 |
| 2021/0266019 | A1* | 8/2021 | Perri | H04B 1/0343 |
| 2021/0306779 | A1* | 9/2021 | Knudsen | H04R 25/604 |
| 2021/0391644 | A1* | 12/2021 | Kawamura | H01Q 9/42 |

FOREIGN PATENT DOCUMENTS

| | | | | |
|---|---|---|---|---|
| EP | 2802037 | A1 | 11/2014 | |
| EP | 3316598 | A1 | 5/2018 | |
| EP | 3554096 | A1 | 10/2019 | |
| WO | 2017153274 | A1 | 9/2017 | |
| WO | WO-2021097783 | A1 * | 5/2021 | H01Q 1/273 |

* cited by examiner

HEARING AID

CROSS-REFERENCE TO RELATED APPLICATION

This application claims the priority, under 35 U.S.C. § 119, of German patent application DE 10 2020 201 480.9, filed Feb. 6, 2020; the prior application is herewith incorporated by reference in its entirety.

BACKGROUND OF THE INVENTION

Field of the Invention

The invention relates to a hearing aid, which is designed in particular as a classical hearing aid.

Classical hearing aids, which are used to care for the hard of hearing, are typically referred to as hearing aids. In the broader meaning, however, this term also refers to devices which are configured to assist people having normal hearing. Such hearing aids are also referred to as "Personal Sound Amplification Products" or "Personal Sound Amplification Devices" (abbreviated: "PSAD"). These are not provided to compensate for hearing losses, but rather are intentionally used to assist and improve the normal human hearing ability in specific hearing situations, for example, to assist hunters when hunting or to assist animal observation, in order to be able to better perceive animal sounds and other noises produced by animals, for sports reporters, in order to enable improved speech and/or speech comprehension in complex background noise, for musicians, in order to reduce the strain on the sense of hearing, etc.

Independently of the provided intended use, hearing aids typically include an input transducer, a data and/or signal processing unit, which typically contains an amplifier, and an output transducer as essential components. The input transducer is generally formed in this case by an acousto-electric transducer, i.e., for example by a microphone, and/or by an electromagnetic receiver, for example an induction coil. An electro-acoustic transducer is usually used as an output transducer, for example a miniature loudspeaker (also referred to as an "earpiece"), or an electromechanical transducer, for example a bone vibrator, and the data and/or signal processing unit is generally implemented by an electronic circuit implemented on a printed circuit board.

Such hearing aids furthermore typically include an antenna unit or an antenna element as a so-called RF antenna, by means of which the hearing aid can be coupled with respect to signaling, for example, to an operating element (remote control) and/or to a further hearing aid. In general, the same antenna unit or the same antenna element is used for transmitting and receiving data for reasons of space.

In a so-called binaural hearing device, two such hearing aids or hearing aid devices are worn by a user, wherein a wireless signal connection exists between the antenna units or antenna elements of the hearing aids in operation. In operation, wireless data, possibly also large quantities of data, are exchanged or transmitted in this case between the hearing aids on the right and left ear. The exchanged data and items of information enable particularly effective adaptation of the hearing aids to a respective acoustic situation. In particular, in this way a particularly authentic room sound is enabled for the user and also the speech comprehension is improved, even in loud environments.

Hearing aids are preferably embodied to be particularly space-saving and compact, so that they can be worn as visually inconspicuously as possible by a hearing aid user. Therefore, smaller, and smaller hearing aids are produced, which have an increasingly higher level of wearing comfort and are therefore hardly perceived by a user when worn on or in an ear. Due to the structural space thus reduced, however, it is increasingly more difficult to house and/or install conventional antenna units or antenna elements for wireless signal transmission in such hearing aids.

These problems occur in particular in the case of in-the-ear hearing aids, which are generally mass produced and are seated deep in an auditory canal or ear canal of the hearing aid user. Such hearing aids are preferably configured with compact structural space in such a way that they are arranged essentially visually invisible in the ear canal in the worn state.

BRIEF SUMMARY OF THE INVENTION

Proceeding therefrom, the invention is based on the object of specifying an advantageously configured hearing aid.

This object is achieved according to the invention by a hearing aid having the features of the independent claim. Preferred refinements are contained in the claims referring thereto.

The hearing aid according to the invention is preferably configured as a hearing aid of a type mentioned at the outset and is typically embodied as an in-the-ear hearing aid (ITE hearing aid), for example as a channel hearing aid (ITE: In-The-Ear, CIC: Completely-In-Channel, IIC: Invisible-In-The-Channel).

In this case, the hearing aid includes a housing having a baseplate, also called a faceplate, and having a housing shell. The housing is preferably formed in two parts here and in this case the baseplate and the housing shell then form the two parts of the housing. Moreover, the baseplate and the housing shell are expediently connected to one another or fastened on one another at least in an assembled state. In particular in this case, the baseplate and the housing shell preferably additionally terminate the hearing aid to the outside.

Furthermore, the hearing aid includes a number of electrical and/or electronic units, i.e., one or more electrical and/or electronic units, also referred to as electrical units or E-units in brief, wherein this number of electrical and/or electronic units are fastened on the baseplate. For example, an input transducer, i.e., for example a microphone, forms one such E-unit. Alternatively, or additionally, a battery or an accumulator forms one such E-unit and/or a data and/or signal processing unit mentioned at the outset, also referred to simply as a data processing unit hereinafter, forms a corresponding E-unit. A corresponding data processing unit typically includes an amplifier or an amplifier function in this case.

In addition, the hearing aid includes a transmitting and receiving unit for transmitting and receiving electromagnetic waves, wherein this includes an electronic circuit for generating a transmission signal and an antenna unit coupled thereto or an antenna element coupled thereto. This antenna unit typically includes an RF antenna of the type mentioned at the outset or forms such an antenna. There-fore, electromagnetic waves in the meaning of this application are to be under-stood in particular as radio signals, which are also referred to as RF signals.

The transmitting and/or receiving unit is now functionally capable and configured to generate and/or evaluate RF signals transmittable or receivable by means of the antenna unit. The transmission range is typically less than 20 m and is, for example, 10 m in this case. A range is to be understood here in particular as the signal range, i.e., a distance of the respective communication or signal connection which can exist at most between a transmitter and a receiver, so that a communication is still possible between them.

Independently thereof, the transmitting and/or receiving unit and in particular the antenna unit is preferably designed for so-called far field emission. I.e., in the transmitting mode, a so-called far field emission is achieved, in which the electromagnetic waves emitted from the antenna unit propagate in the far field, also called the Fraunhofer region. The information transmission is thus preferably not implemented by an inductive and/or capacitive coupling between transmitter and receiver. An electrical field or a predominantly electrical field is typically generated here at the antenna unit itself or using the antenna unit. At least the electrical component of the field is dominant in the immediate surroundings of the antenna unit. The antenna unit is thus in particular capable and configured to receive or absorb and to transmit or emit electromagnetic radio waves.

The antenna unit is furthermore preferably configured as a radio frequency antenna (RF antenna) or as an RF resonator, for example for a 2.4 GHz Bluetooth transmission by means of an ISM frequency band (ISM: Industrial, Scientific, and Medical). In any case, however, the transmitting and/or receiving unit and in particular the antenna unit is designed in such a way that a wireless communication is enabled, in particular with other electronic devices, for example with other hearing aids (for example to form a binaural hearing aid system or hearing aid device system), with remote controls, with programming devices, or with mobile tele-phones. The wireless communication typically takes place in this case by means of electromagnetic waves in the radio frequency range of 500 kHz to 5 GHz and preferably in the frequency range of 500 MHz to 5 GHz.

In the worn state, the hearing aid is preferably arranged essentially completely, but at least partially, in an ear channel or auditory channel of the user. The antenna element and/or the transmitting and/or receiving unit are preferably capable and designed here to correct attenuation and/or detuning of the RF signals due to the head of the user.

In the hearing aid according to the invention, the antenna unit now has a first antenna arm and a shielding element for shielding the first antenna arm against the number of E-units. In the meaning of this application, an antenna arm is typically understood as an elongated conductor element, i.e., in particular an elongated conductor/conductor wire or an elongated conductor track, and the shielding element typically has an electrical conductor element, i.e., in particular a conductor/conductor wire or a conductor track, or is formed by an electrical conductor element, i.e., in particular by a conductor/conductor wire or a conductor track. Moreover, the antenna arm and the shielding element are preferably formed from the same material, typically from the same metal or the same metal alloy.

Due to the shielding effect of the shielding element, freedoms advantageously result in the design of the hearing device and in particular in the design of the antenna unit in such a way that in the selection of the resonant frequencies or the resonant frequency for the antenna unit, possible interference frequencies from the E-units do not have to be taken into consideration, so that antenna unit and E-units can be optimized quasi-independently of one another.

The possibility is thus provided, for example, of using a simpler amplifier or a simpler amplifier function and thus a simpler data processing unit for the amplification of transmission signals and/or reception signals. In at least one application, the hearing aid then also has such a simpler amplifier or a simpler data processing unit. Moreover, a corresponding amplifier may be positioned more freely, i.e., less is to be taken into consideration in the selection of a suitable position for the amplifier. Reference is typically made in such cases to a "floating amplifier".

Due to the additional freedoms in the specification of the resonant frequency or the resonant frequencies, it is moreover possible in some cases to dispense with adaptation elements, for example an ohmic resistor, a coil, a capacitor, and/or a so called balun, and in the case of at least one embodiment the antenna unit also does not include such an adaptation element. I.e., in at least one application an adaptation element of the above-mentioned type is omitted in the hearing aid according to the invention.

Furthermore, an embodiment is advantageous in which the first antenna arm is formed as a free arm. In the meaning of this application, a free arm is to be understood in particular as an elongated conductor element, for example an elongated conductor/conductor wire or an elongated conductor track, having at least one exposed end or free end. Independently thereof, the antenna unit is preferably configured solely for one resonant frequency. Furthermore, the antenna unit preferably only has the one above-mentioned free arm.

Notwithstanding this, the shielding element is expediently positioned between the first antenna arm and the number of E-units. Moreover, the shielding element is preferably positioned between the first antenna arm and the electronic circuit of the transmitting and receiving unit.

Furthermore, it is advantageous if the shielding element includes or forms a curved conductor, a conductor loop, or a conductor hoop. A geometry of the shielding element is typical in this case in which the shielding element is formed at least approximately annularly, i.e., has a ring shape. The geometry does not necessarily correspond to a geometrical circle here, however. Moreover, the ring shape is also not necessarily closed. The curved conductor, the conductor loop, or the conductor hoop preferably spans at least an arc range or angle range of at least 120°, however, furthermore preferably at least 180°, and in particular at least 300°. If the shielding element includes a conductor loop or conductor hoop, the number of E-units is thus expediently positioned within the conductor loop or the conductor hoop and/or the electronic circuit of the transmitting and receiving unit is positioned within the conductor loop or the conductor hoop. If the shielding element includes a curved conductor, it thus typically at least partially encloses the number of E-units and/or the electronic circuit of the transmitting and receiving unit.

Independently thereof, an embodiment of the shielding element is advantageous in which it includes an auxiliary component. If the shielding element then moreover includes a curved conductor, a conductor loop, or a conductor hoop, the auxiliary component is preferably integrated in the curved conductor, in the conductor loop, or in the conductor hoop, so that the auxiliary component more or less forms a part or a segment of the curved conductor, the conductor loop, or the conductor hoop, or so that the auxiliary component quasi-replaces a conductor section or a conductor segment of the curved conductor, the conductor loop, or the conductor hoop. The auxiliary component is typically an electrical component having an ohmic resistance, having a capacitance, and/or having an inductance, i.e., for example, a capacitor, a coil, a resistor, or simply a conductor interruption, i.e., a quasi-gap.

In particular if the shielding element includes a type of conductor loop, it is moreover advantageous if the first antenna arm at least partially encloses the shielding element and at the same time spans or covers, for example, an arc range or angle range of at least 90°. The curve of the first antenna arm then further preferably follows the curve of the shielding element in a good approximation in at least one section, wherein the first antenna arm moreover preferably extends at approximately equal distance to the shielding element in this region.

Furthermore, a design variant is favorable in which the first antenna arm is connected via a second antenna arm to the shielding element. The second antenna arm is preferably connected at a first end of the first antenna arm to the first antenna arm in this case. Depending on the embodiment variant, the second antenna arm moreover includes an auxiliary component of the above-mentioned type or is formed by such an auxiliary component.

Independently thereof, an embodiment is expedient in which the first antenna arm is connected via an auxiliary component of the above-mentioned type to the shielding element. This auxiliary component is preferably connected here at a second end of the first antenna arm to the first antenna arm.

It is also expedient if the first antenna arm is connected via a feed arm to the electrical circuit of the transmitting and receiving unit. A corresponding feed arm is furthermore preferably positioned here at a predetermined distance from an above-mentioned second antenna arm.

In one advantageous refinement, the antenna unit is designed like a so-called PIF antenna (Planar Inverted F-Shaped Antenna). In this case, a ground potential or reference potential is then typically specified for the shielding element in operation of the hearing aid. An above-mentioned second antenna arm, an above-mentioned feed arm, and the first antenna arm then typically form an F-shaped main pattern made of a conductive material, for example copper.

Furthermore, an embodiment is preferred in which the antenna unit or at least a subunit having the first antenna arm and having the shielding element only has a very small extension in one spatial direction, typically less than or equal to 1 mm, and in which at least the first antenna arm and the shielding element essentially lie in a plane, the normal of which is oriented in parallel to this spatial direction.

Independently thereof, the antenna unit is typically not formed by a film structure. The shielding element is in particular preferably not formed by a film. Instead, the antenna unit or at least a subunit having the first antenna arm and having the shielding element is preferably formed by conductor tracks and/or by conductor wires.

Moreover, the antenna unit or at least the above-mentioned subunit is preferably formed by a number of conductor tracks, which are in particular applied to a substrate or to the baseplate. In this case, the conductor tracks are printed on or applied with the aid of a coating method, for example. If used, for example, a film or a flexible printed circuit board (flexible PCB) is used in this case as the substrate.

Alternatively, the antenna unit has a significant extension in three orthogonal spatial directions. In such a case, the antenna unit is furthermore preferably at least partially and in particular completely embedded in a plastic, which forms the baseplate, for example.

According to one advantageous embodiment, the antenna unit additionally includes an electrically conductive auxiliary arm, which is connected to the first antenna arm. If the first antenna arm and the shielding element then moreover lie essentially in one plane, the auxiliary arm is preferably guided or tilted out of this plane. Depending on the intended application, moreover a further conductor or a further conductor structure adjoins the auxiliary arm, which furthermore preferably lies outside the plane and/or is quasi-held/supported by the auxiliary arm and/or is connected via the auxiliary arm to the first antenna arm.

According to a further embodiment variant, the antenna unit furthermore includes a connecting element, with the aid of which in particular the above-mentioned feed arm of the antenna unit is connected to the electronic circuit of the transmitting and receiving unit. Such a connecting element is preferably formed here as a type of waveguide. Depending on the application, such a waveguide is designed as a strip guide, i.e., for example as a so-called "slot waveguide" "slot-line wave-guide", or "microstrip-line waveguide", and/or as a coplanar waveguide. According to one embodiment variant, the waveguide includes in this case, for example, three parallel conductor strips lying in a plane, wherein, for example, two outer conductor strips are at a ground potential or reference potential in operation of the hearing aid and wherein a middle conductor strip is used for signal conduction in operation. Moreover, a connecting element which is designed as a coaxial cable is advantageous.

It is additionally expedient if a ground potential or reference potential is specified in operation of the hearing aid and if the shielding element is connected to the electronic circuit of the transmitting and receiving unit to specify the ground potential or reference potential. Depending on the embodiment variant, in this way the ground potential or reference potential is then specified for the shielding element or for the electronic circuit.

Alternatively, or additionally thereto, to specify a ground potential or reference potential or the above-mentioned ground potential or reference potential, the shielding element is connected to at least one of the E-units from the number of E-units, for example to a battery or an accumulator of the hearing aid.

Other features which are considered as characteristic for the invention are set forth in the appended claims.

Although the invention is illustrated and described herein as embodied in a hearing aid, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Parts corresponding to one another are each provided with the same reference signs in all figures.

Figure 1:
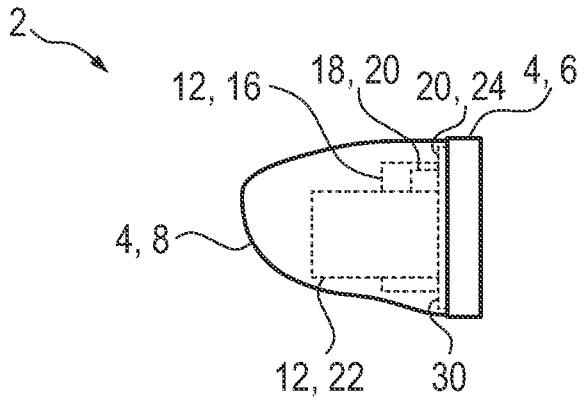
FIG. 1 is a simplified and partially transparent illustration of a hearing aid having an antenna unit in a first embodiment according to the invention.

Referring now to the figures of the drawings in detail and first, particularly to FIG. 1 thereof, there is shown a hearing aid 2 described as an example in a simplified and partially transparent illustration and includes a housing 4 having a baseplate 6 and having a housing shell 8. In this case, the housing 4 is configured in such a way that the baseplate 6 is reversibly detachably connected to the housing shell 8 when the housing 4 is formed and the baseplate 6 may be detached from the housing shell 8 by actuating a pushbutton 10 on the baseplate 6.

Furthermore, in the exemplary embodiment multiple electrical and/or electronic units, referred to as E-units 12 in short hereinafter, are fastened on the baseplate 6. In the exemplary embodiment according to FIG. 3, two microphones 14 each form one of these E-units 12. Furthermore, a data processing unit 16 forms an E-unit 12 and two further E-units 12 are formed by an electronic circuit 18 of a transmitting and receiving unit 20 and by a battery 22.

Figure 2:
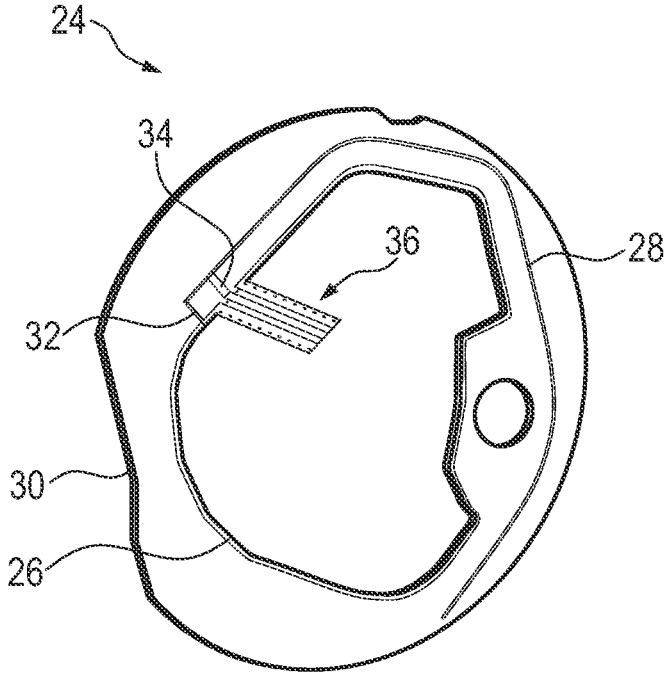
FIG. 2 is shows a perspective view of the antenna unit according to the first embodiment.

In this case, the transmitting and receiving unit 20 is configured to transmit and receive electromagnetic waves in operation of the hearing aid 2, in particular to communicate with a second hearing aid (not shown). The electronic circuit 18 and an antenna unit 24, as shown in FIG. 2, are part of the transmitting and receiving unit 20. That antenna unit 24 is configured in the exemplary embodiment as a so-called PIF antenna and includes a shielding element 26, for which a ground potential or reference potential is specified in operation of the hearing aid 2.

That shielding element 26 is formed in the exemplary embodiment according to FIG. 2 by a conductor loop, which has a ring shape in a rough approximation. In this case, the shielding element 26 surrounds or encloses the above-mentioned E-units 12 and in this way shields a first antenna arm 28 of the antenna unit 24 from these E-units 12. The first antenna arm 28 is formed as a free arm in the exemplary embodiment according to FIG. 2.

Shielding element 26 and first antenna arm 28 lie in one plane here and both are respectively formed as conductor tracks, for example from copper. Depending on the embodiment variant, the conductor tracks are, for example, applied, for example printed, onto a substrate 30, which is also shown in FIG. 2 and is typically part of the antenna unit 24. In the exemplary embodiment, a film forms the substrate 30 and to form the hearing aid 2, this film is preferably quasi-slipped over the E-units 12 together with the already applied conductor tracks, applied to the baseplate 6 of the housing 4, and adhesively bonded to the baseplate 6. In this state, the E-units 12 penetrate a passage in the substrate 30.

In the exemplary embodiment, the above-mentioned first antenna arm 28 at least partially encloses the shielding element 26 and is connected at a first end via a second antenna arm 32 to the shielding element 26. Moreover, a feed arm 34 branches off from the first antenna arm 28 spaced apart from the second antenna arm 32 in the exemplary embodiment, via which the antenna unit 24 is galvanically connected to the electronic circuit 18 of the transmitting and receiving unit 20.

Moreover, in the exemplary embodiment a connecting element 36 is part of the antenna unit 24, which is formed as a coplanar waveguide in FIG. 2 and connects the feed arm 34, on the one hand, and the shielding element 26, on the other hand, to the electronic circuit 18 of the transmitting and receiving unit 20. For this purpose, the connecting element 36 has three coplanar, parallel conductor strips, of which the two outer conductor strips are each connected to one end of the loop shape of the shielding element 26. The middle conductor strip positioned between the outer conductor strips is additionally connected to the feed arm 34 and then a sensor signal can be fed via this into the antenna unit 24 and/or a received signal can be read out. Depending on the embodiment variant, the connecting element 36 is tilted out of the plane in which the shielding element 26 and the first antenna arm 28 extend, and, for example, protrudes perpendicularly from the substrate 30.

Figure 3:
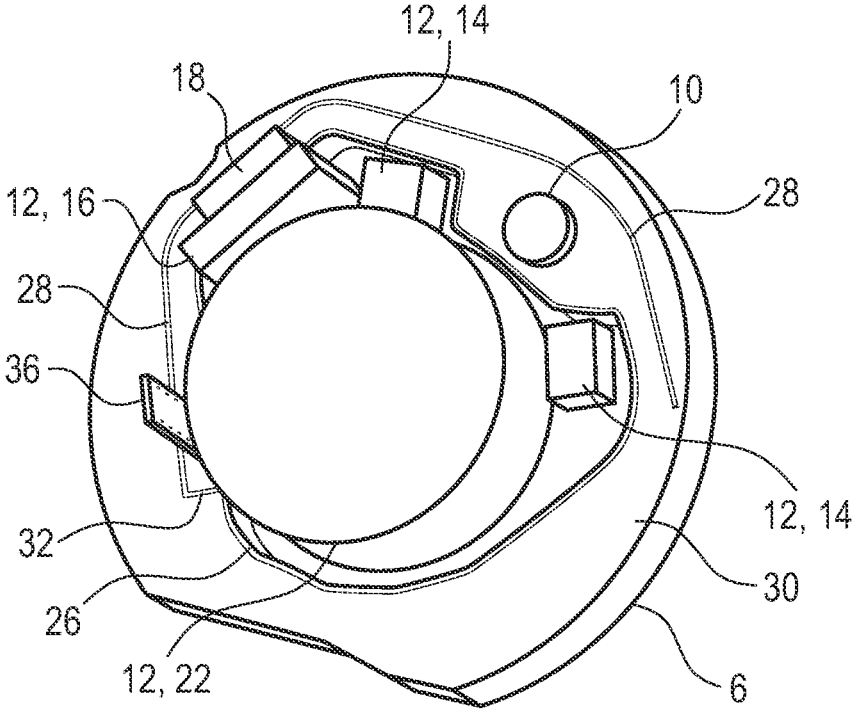
FIG. 3 is perspective view of the antenna unit in the first embodiment together with further components of the hearing aid.

As is apparent from the illustration according to FIG. 3, the pushbutton 10 in the exemplary embodiment is positioned outside the shielding element 26. More precisely, the pushbutton 10 is arranged between first antenna arm 28 and shielding element 26. Alternatively, the pushbutton 10 is arranged within the shielding element 26 or outside the first antenna arm 28, i.e., outside the shielding element 26 and outside an intermediate space between shielding element 26 and first antenna arm 28.

Figure 4:
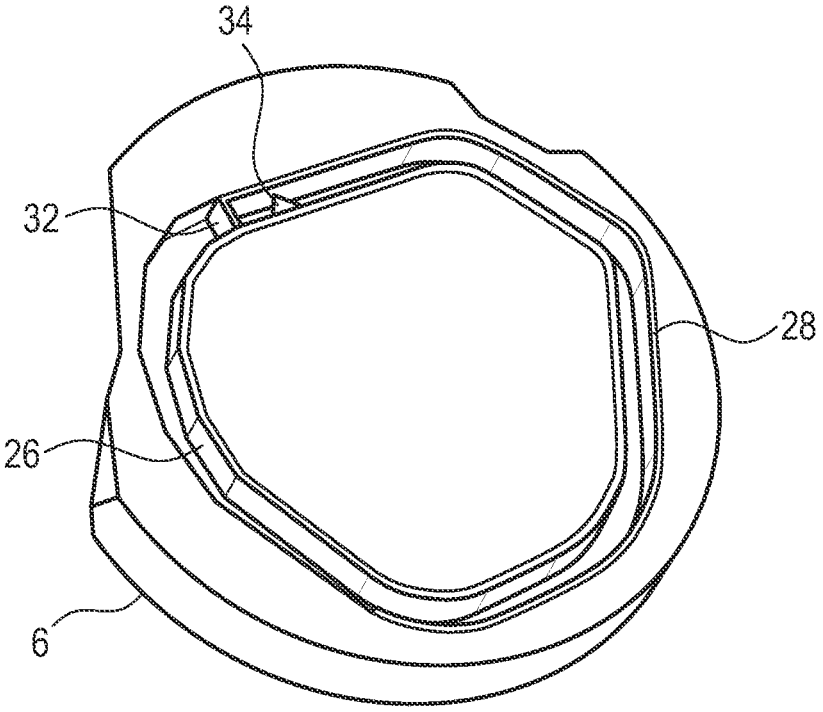
FIG. 4 is a perspective view of a part of the antenna unit in a second embodiment.

A modified embodiment of the antenna unit 24 is shown or at least indicated in FIG. 4. The shielding element 26 and the first antenna arm 28 have significant extensions in three orthogonal spatial directions here, so that reference can only be made to a limited extent if at all to an arrangement in one plane. Band like conductor structures form the first antenna arm 28 and the shielding element 26 here. In such an embodiment, the shielding element 26 and the first antenna arm 28 are preferably embedded in a plastic compound, in particular a plastic compound which forms the baseplate 6.

Figure 5:
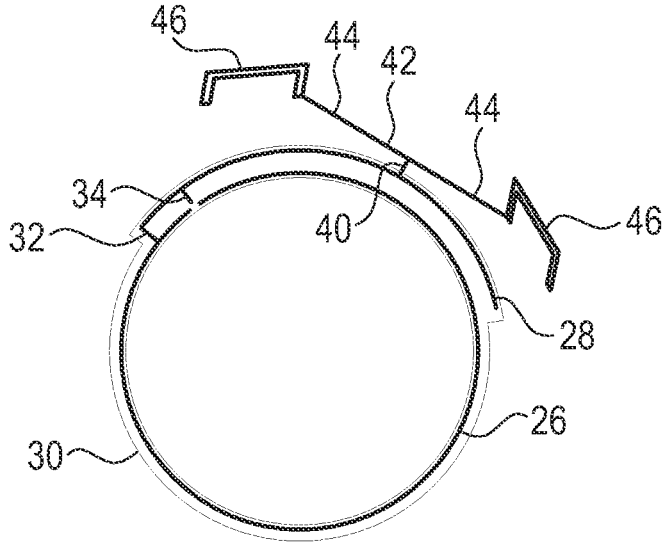
FIG. 5 is a fourth perspective view of a part of the antenna unit in a third embodiment having an auxiliary arm and a further conductor structure connected thereto.

The schematic illustration in FIG. 5 shows a third embodiment of the antenna unit 24. The essential difference from the embodiment according to FIG. 3 is an additional conductor structure 38 having an auxiliary arm 40, which, in contrast to the shielding element 26, the first antenna arm 28, the second antenna arm 32, and the feed arm 34, does not lie in the above-mentioned plane, but rather is guided or tilted out of this plane. The auxiliary arm 40 is thus in particular not embodied as a conductor track on the substrate 30, but as a conductor wire which protrudes from the substrate 30.

Figure 6:
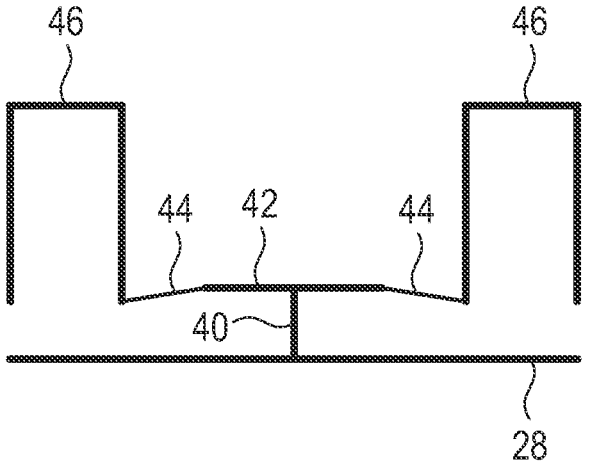
FIG. 6 is an illustration of the auxiliary arm and the further conductor structure connected thereto.

In the exemplary embodiment according to FIG. 5, a cross conductor 42 adjoins the auxiliary arm 40, which forms a T shape together with the auxiliary arm 40. A transition arm 44 in turn adjoins the cross conductor 42 in each case at both ends, wherein a bend is formed between each transition arm 44 and the cross conductor 42. Finally, a U-shaped conductor element 46 adjoins each transition arm 44, wherein the opening of the U shape preferably faces toward the first antenna arm 28. The additional conductor structure 38 formed from auxiliary arm 40, cross conductor 42, transition arms 44, and U-shaped conductor elements 46 is shown from a second perspective and enlarged in FIG. 6.

Figure 7:
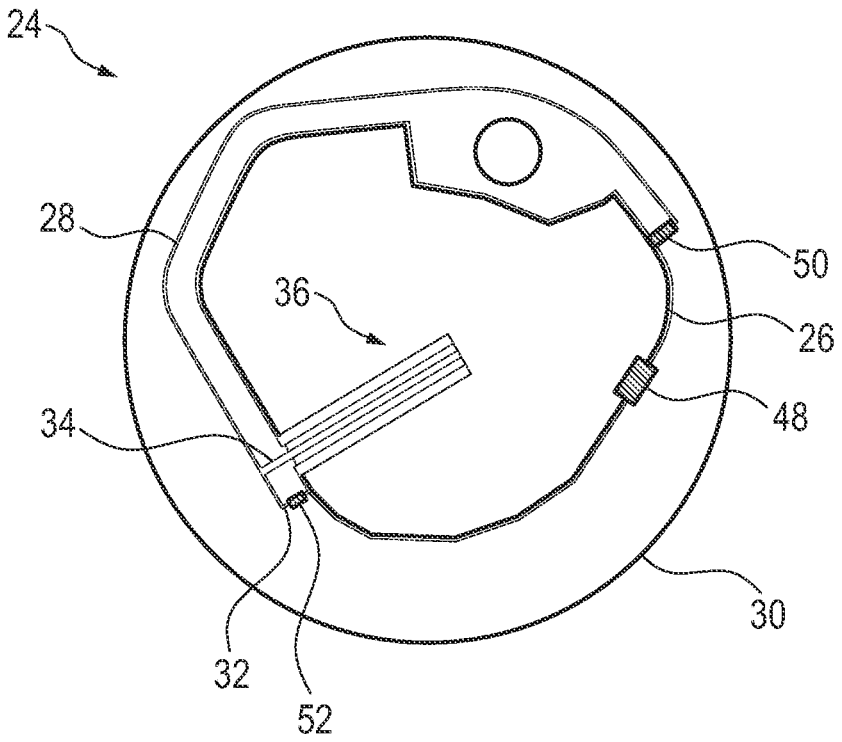
FIG. 7 is a perspective view of the antenna unit according to a fourth embodiment.

A fourth embodiment variant of the antenna unit 24 is shown in FIG. 7. Starting from the embodiment according to FIG. 3, the fourth embodiment variant differs by way of three auxiliary components 48, 50, 52, which are part of the antenna unit 24. Two of these auxiliary components 48, 52 are quasi integrated in the conductor tracks of the antenna unit 24 and each replace a section of a conductor track on the substrate 30 proceeding from the embodiment according to FIG. 3. The auxiliary component 48 is part of the shielding element 26 here and accordingly is incorporated into the conductor track of the shielding element 26. The auxiliary component 52 is incorporated into the conductor track of the second antenna arm 32. The third auxiliary component 50 connects the second end of the first antenna arm 28 to the shielding element 26.

The three auxiliary components 48, 50, 52 are configured identically or differently depending on the intended application. Independently thereof, a corresponding element is typically an electrical component having an ohmic resistance, having a capacitance, and/or having an inductance, i.e., for example a capacitor, a coil, a resistor, or simply a conductor interruption, i.e., a quasi-gap.

LIST OF REFERENCE NUMERALS

2 hearing aid
4 housing
6 baseplate (faceplate)
8 housing shell
10 pushbutton
12 E-unit
14 microphone
16 data processing unit
18 electronic circuit
20 transmitting and receiving unit
22 battery
24 antenna unit
26 shielding element
28 first antenna arm
30 substrate
32 second antenna arm
34 feed arm
36 connecting element
38 additional conductor structure
40 auxiliary arm
42 cross conductor
44 transition arm
46 conductor element
48 auxiliary component
50 auxiliary component
52 auxiliary component

The invention claimed is:

1. A hearing aid, comprising:
a housing having a baseplate and a housing shell;
a plurality of electrical units fastened on said baseplate; and
a transmitting and receiving unit for transmitting and receiving electro-magnetic waves, said transmitting and receiving unit including an electronic circuit for generating a transmission signal and an antenna unit coupled on said electronic circuit, said antenna unit having a first antenna arm and a shielding element for shielding said first antenna arm against said plurality of electrical units, said shielding element having a conductor loop.

2. The hearing aid according to claim 1, wherein said first antenna arm is formed as a free arm.

3. The hearing aid according to claim 1, wherein said shielding element is positioned between said first antenna arm and said plurality of electrical units.

4. The hearing aid according to claim 1, wherein said shielding element is positioned between said first antenna arm and said electronic circuit of said transmitting and receiving unit.

5. The hearing aid according to claim 1, wherein said shielding element includes an auxiliary component.

6. The hearing aid according to claim 1, wherein said first antenna arm at least partially encloses said shielding element.

7. The hearing aid according to claim 1, wherein:
said antenna unit has a second antenna arm; and
said first antenna arm is connected via said second antenna arm to said shielding element.

8. The hearing aid according to claim 7, wherein said second antenna arm is connected to a first end of said first antenna arm.

9. The hearing aid according to claim 7, wherein said second antenna arm has an auxiliary component.

10. A hearing aid, comprising:
a housing having a baseplate and a housing shell;
a plurality of electrical units fastened on said baseplate; and
a transmitting and receiving unit for transmitting and receiving electro-magnetic waves, said transmitting and receiving unit including an electronic circuit for generating a transmission signal and an antenna unit coupled on said electronic circuit, said antenna unit having a first antenna arm and a shielding element for shielding said first antenna arm against said plurality of electrical units, said antenna unit having an auxiliary component and said first antenna arm is connected via said auxiliary component to said shielding element.

11. The hearing aid according to claim 10, wherein said auxiliary component is connected to a second end of said first antenna arm.

12. The hearing aid according to claim 1, wherein said antenna unit has a feed arm and said first antenna arm is connected via said feed arm to said electronic circuit of said transmitting and receiving unit.

13. The hearing aid according to claim 1, wherein said first antenna arm and said shielding element lie in one plane.

14. The hearing aid according to claim 1, wherein said antenna unit includes a substrate and a plurality of conductor tracks, said conductor tracks are applied to said substrate or to said baseplate.

15. A hearing aid, comprising:
a housing having a baseplate and a housing shell;
a plurality of electrical units fastened on said baseplate; and
a transmitting and receiving unit for transmitting and receiving electro-magnetic waves, said transmitting and receiving unit including an electronic circuit for generating a transmission signal and an antenna unit coupled on said electronic circuit, said antenna unit having a first antenna arm and a shielding element for shielding said first antenna arm against said plurality of electrical units, said antenna unit having an electrically conductive auxiliary arm being connected to said first antenna arm.

16. The hearing aid according to claim 15, wherein said first antenna arm and said shielding element lie in one plane and said electrically conductive auxiliary arm is guided out of the plane.

17. The hearing aid according to claim 1, further comprising a waveguide, said electronic circuit of said transmitting and receiving unit is connected via said waveguide to said antenna unit.

18. The hearing aid according to claim 1, further comprising a coaxial cable, said electronic circuit of said transmitting and receiving unit is connected via said coaxial cable to said antenna unit.

19. The hearing aid according to claim 1, wherein said shielding element is connected to at least one of the following units to specify a ground potential:

said electronic circuit of said transmitting and receiving unit; or one of said electrical units from said plurality of electrical units.

* * * * *